US008690094B2

(12) United States Patent
Yu Chen

(10) Patent No.: US 8,690,094 B2
(45) Date of Patent: Apr. 8, 2014

(54) FILM PACKING DEVICE

(76) Inventor: Hsiu-Man Yu Chen, Taichung (TW)

( * ) Notice: Subject to any disclaimer, the term of this patent is extended or adjusted under 35 U.S.C. 154(b) by 535 days.

(21) Appl. No.: 13/033,704

(22) Filed: Feb. 24, 2011

(65) Prior Publication Data

US 2012/0217336 A1 Aug. 30, 2012

(51) Int. Cl.
*B65H 23/06* (2006.01)

(52) U.S. Cl.
USPC ..... 242/422.4; 242/597.6

(58) Field of Classification Search
USPC ..... 242/588, 588.2, 422, 422.4, 422.5, 242/597.6
See application file for complete search history.

(56) References Cited

U.S. PATENT DOCUMENTS

| | | | | |
|---|---|---|---|---|
| 7,380,744 | B1 * | 6/2008 | Yu Chen | 242/422.4 |
| 7,726,600 | B2 * | 6/2010 | Huang | 242/588.2 |
| 2010/0044491 | A1 * | 2/2010 | Ritchey et al. | 242/422.4 |

* cited by examiner

*Primary Examiner* — Emmanuel M Marcelo
*Assistant Examiner* — Angela Caligiuri
(74) *Attorney, Agent, or Firm* — Ming Chow; Sinorica, LLC

(57) ABSTRACT

A film packing device includes an axle rod and a grasp pipe. The axle rod includes at least one engaging block protruding from one side thereof. The pipe body is fitted on the axle rod. The pipe body includes a semi-circle brake block at one end thereof close to the engaging block. The brake block is coupled with a semi-circle elastic brake member. The elastic brake member has a slide block corresponding to the engaging block. When in use, the elastic brake member cooperates with the brake block to press the axle rod, such that the axle rod stops rotating. The slide block can be pushed to engage with the engaging block to stop rotation of the axle rod, so that the user can pack an article conveniently.

4 Claims, 8 Drawing Sheets

FILM PACKING DEVICE

BACKGROUND OF THE INVENTION

1. Field of the Invention

The present invention relates to a film packing device.

2. Description of the Prior Art

In order to avoid an article from falling during transportation, a roll of film is used to pack the article for providing a secure effect. In general, a film reel is provided in the roll of film. The user uses a film packing device to connect two sides of the roll of film for packing. A conventional film packing device has an axle rod and a grasp pipe which is fitted on the axle rod and rotatable. When in use, the user installs a roll of film on the axle rod and grasps the grasp pipe to pull the roll of film through rotation of the axle rod for packing.

However, when wrapping an article with the film which is pulled out, the axle rod must be kept immovable. In particular, when the film goes around one corner of the article, it is required to do so, such that the article can be wrapped tightly. The conventional packing device doesn't have a mechanism to temporarily stop rotating the axle rod. When pulling the film, the axle rod may be rotated simultaneously. Accordingly, the inventor of the present invention has devoted himself based on his many years of practical experiences to solve this problem.

SUMMARY OF THE INVENTION

The present invention is to provide a film packing device which can be stopped temporarily when in use.

In order to achieve the aforesaid object, there is provided a film packing device. The film packing device comprises an axle rod and a grasp pipe. The axle rod comprises at least one engaging block protruding from one side thereof. The axle rod is adapted to install a roll of film thereon. The grasp pipe has a pipe body. The pipe body is fitted on the axle rod and rotatable. The pipe body comprises a semi-circle brake block at one end thereof close to the engaging block. The brake block has two opposing sides defined as a first side and a second side. The brake block is coupled with a semi-circle elastic brake member. One end of the elastic brake member is integrally formed with the first side of the brake block, and another end of the elastic brake member is a free end and located corresponding to the second side of the brake block. The elastic brake member has an axial slide channel. A slide block is provided in the slide channel. The slide block is able to be slid out of the slide channel to engage with the engaging block.

Accordingly, when in use, the user just holds the grasp pipe to pull the roll of film through rotation of the axle rod. The film packing device of the present invention can assist the user in packing. The present invention is user-friendly. When the user wants to stop pulling of the roll of the film for a while, the user can press the press portion to push the elastic brake member downward. The elastic brake member cooperates with the brake block to press the axle rod, such that the axle rod stops rotating. When the user wants to stop using the roll of film for a long time, the push block is pushed to link the slide block. The slide block is pushed out of the slide channel, such that the slide block engages with the engaging block to stop rotation of the axle rod. Thus, the operation of packing can be stopped temporarily as desired.

DETAILED DESCRIPTION OF THE PREFERRED EMBODIMENTS

Figure 1:
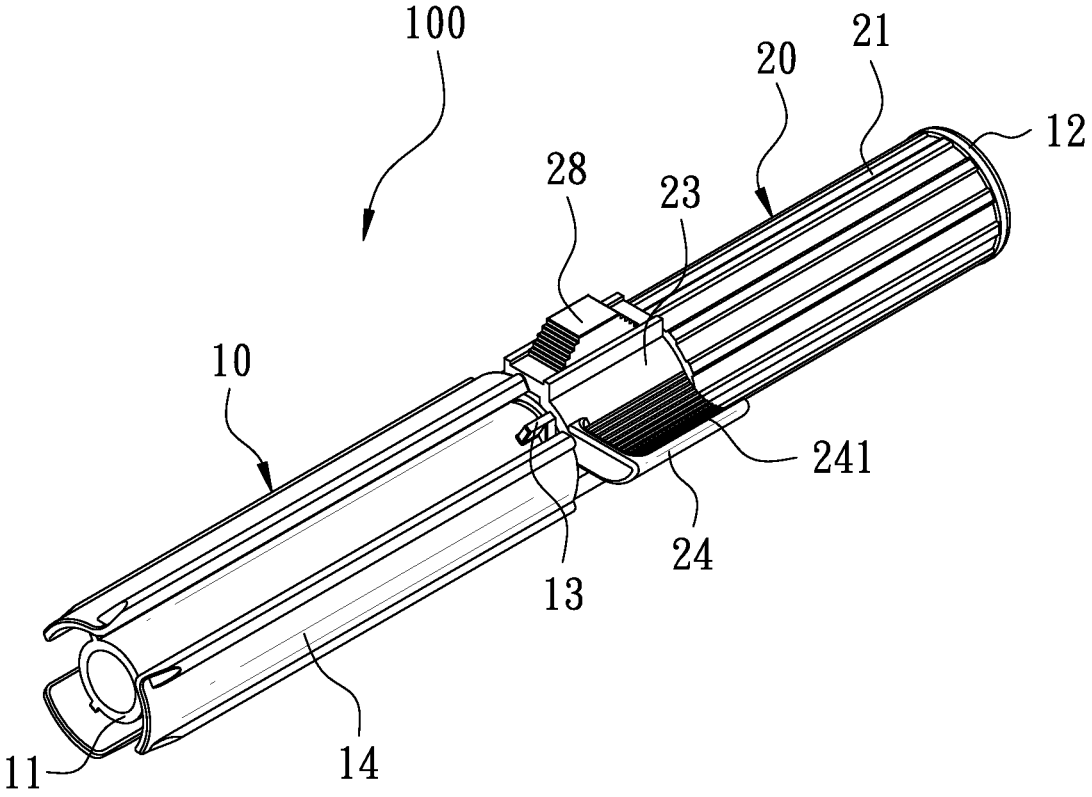
FIG. 1 is a perspective view according to a preferred embodiment of the present invention.
Figure 2:
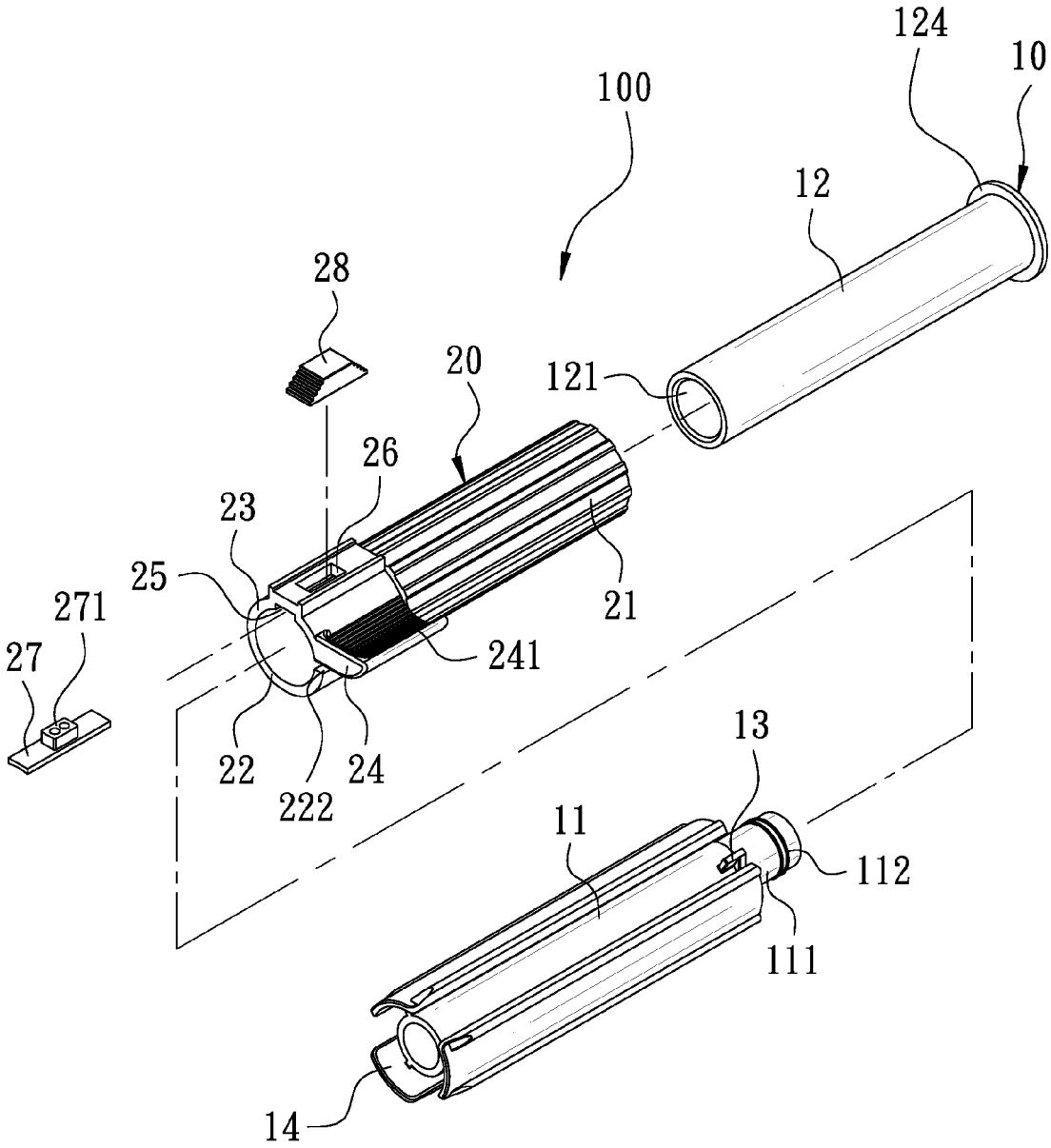
FIG. 2 is an exploded view according to the preferred embodiment of the present invention.
Figure 3:
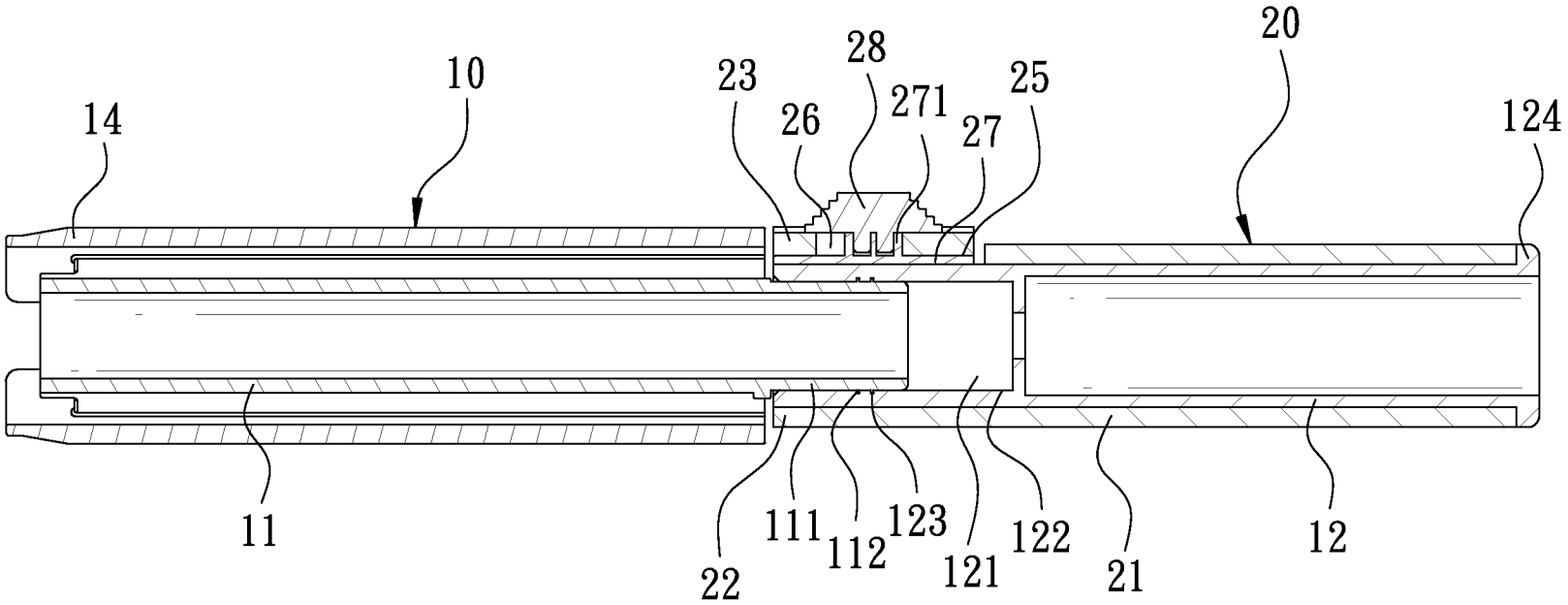
FIG. 3 is an axial cross-sectional view according to the preferred embodiment of the present invention.
Figure 4:
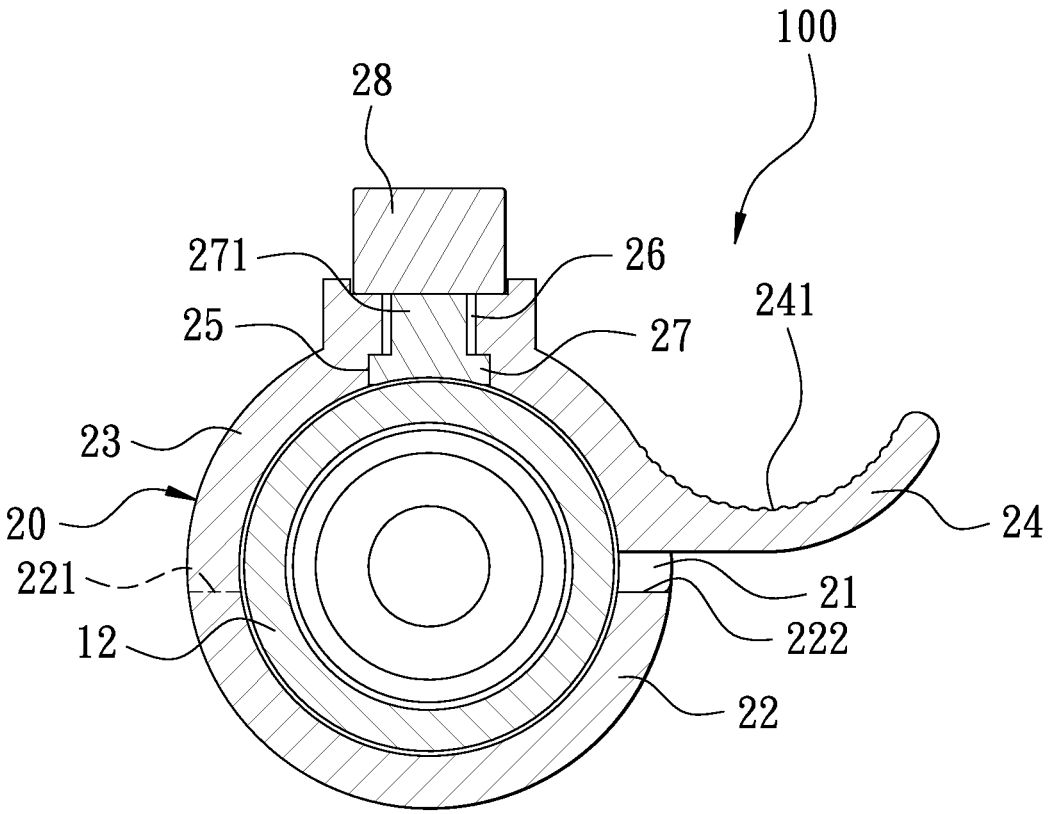
FIG. 4 is a side cross-sectional view according to the preferred embodiment of the present invention.

Embodiments of the present invention will now be described, by way of example only, with reference to the accompanying drawings.

As shown in FIG. 1 to FIG. 5, a film packing device 100 according to a preferred embodiment of the present invention comprises an axle rod 10 and a grasp pipe 20.

The axle rod 10 comprises a connecting pipe 11 and a fixing pipe 12 which are connected to each other. The connecting pipe 11 has a positioning block 111 at one end thereof. The positioning block 111 has a plurality of engaging rings 112 on an outer surface thereof. The fixing pipe 12 has a positioning trough 121 at one end thereof. The positioning trough 121 corresponds to the positioning block 111 and has an inner wall 122 which is formed with engaging grooves 123 corresponding to the engaging rings 112. Thus, the positioning block 111 of the connecting pipe 11 is inserted into the positioning trough 121 of the fixing pipe 12 with the engaging rings 112 to engage with the engaging grooves 123. The axle rod 10 further comprises at least one engaging block 13 protruding from one side thereof. In this embodiment, the axle rod 10 comprises a plurality of engaging blocks 13. The axle rod 10 further comprises a plurality of spaced tightening pieces 14 thereon. In this embodiment, the tightening pieces 14 are axially disposed on the connecting pipe 11. The fixing pipe 12 has an enlarged stop portion 124 at another end thereof.

Figure 5:
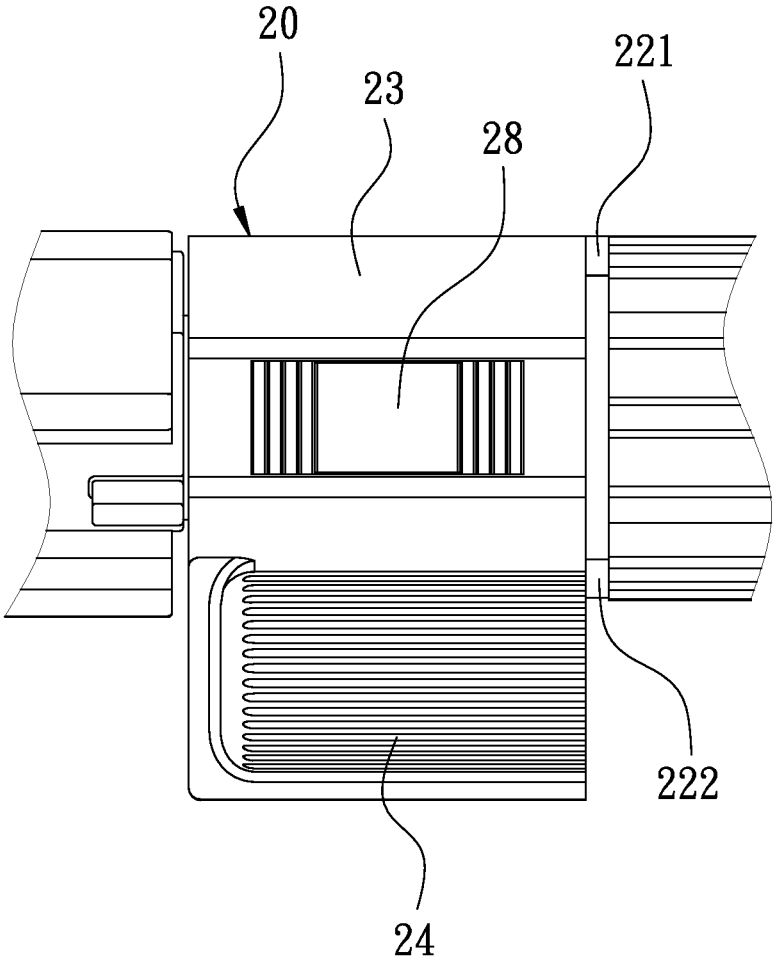
FIG. 5 is a partial enlarged view according to the preferred embodiment of the present invention.

The grasp pipe 20 has a pipe body 21. The pipe body 21 is fitted on the axle rod 10 and is rotatable. In this embodiment, the pipe body 21 is fitted on the fixing pipe 12 and located between the connecting pipe 11 and the stop portion 124 of the fixing pipe 12. The pipe body 21 comprises a semi-circle brake block 22 at one end thereof close to the engaging block 13. As shown in FIG. 5, the brake block 22 has two opposing sides defined as a first side 221 and a second side 222. The brake block 22 is coupled with a semi-circle elastic brake member 23. One end of the elastic brake member 23 is integrally formed with the first side 221 of the brake block 22, and another end of the elastic brake member 23 is a free end and located corresponding to the second side 222 of the brake block 22. The elastic brake member 23 has a press portion 24 extending outward from the free end of the elastic brake member 23. The press portion 24 has a concave 241 thereon for the user to press the elastic brake member 23. Furthermore, the elastic brake member 23 has an axial slide channel 25. In this embodiment, the slide channel 25 is disposed on an inner side of the elastic brake member 23 facing the brake block 22. The elastic brake member 23 has a through hole 26 which communicates with the slide channel 25 and is disposed opposite to the brake block 22. A slide block 27 is provided in the slide channel 25. The slide block 27 can be slid out of slide channel 25 to engage with the engaging block 13. The slide block 27 has a connection portion 271 corresponding to the through hole 26. A push block 28 is connected to the connection portion 271. The push block 28 is located on an outer side of the elastic brake member 23 opposite to the brake block 22. The user can operate the push block 28 to link the slide block 27.

Figure 6:
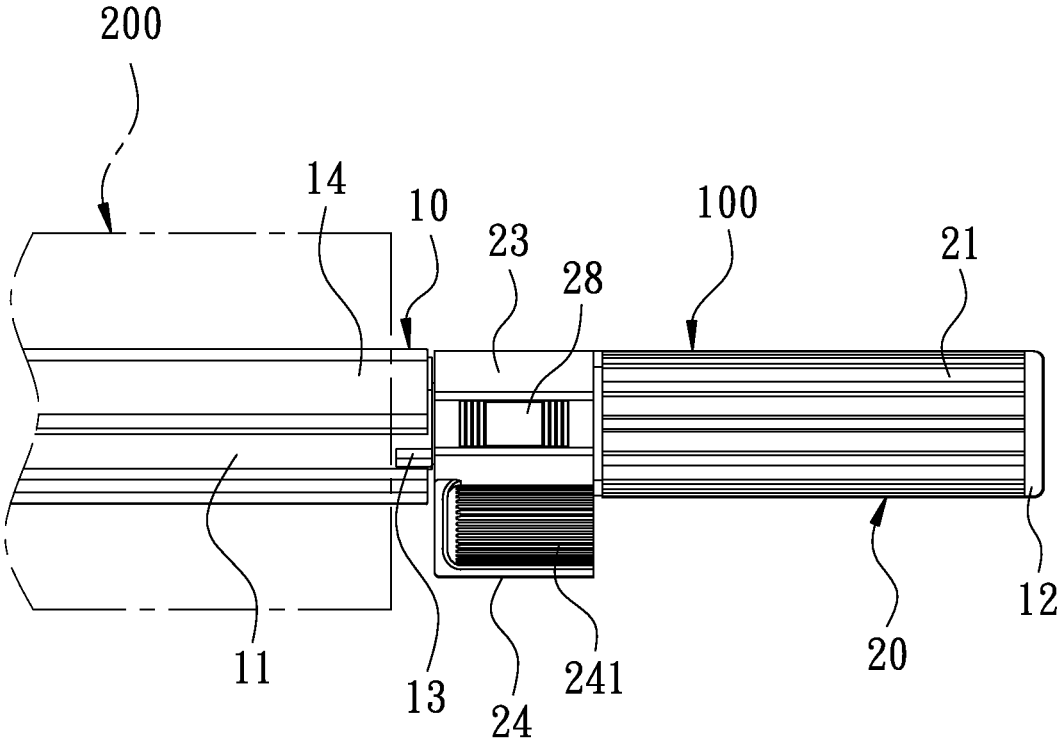
FIG. 6 is a schematic view according to the preferred embodiment of the present invention when in use.
Figure 7:
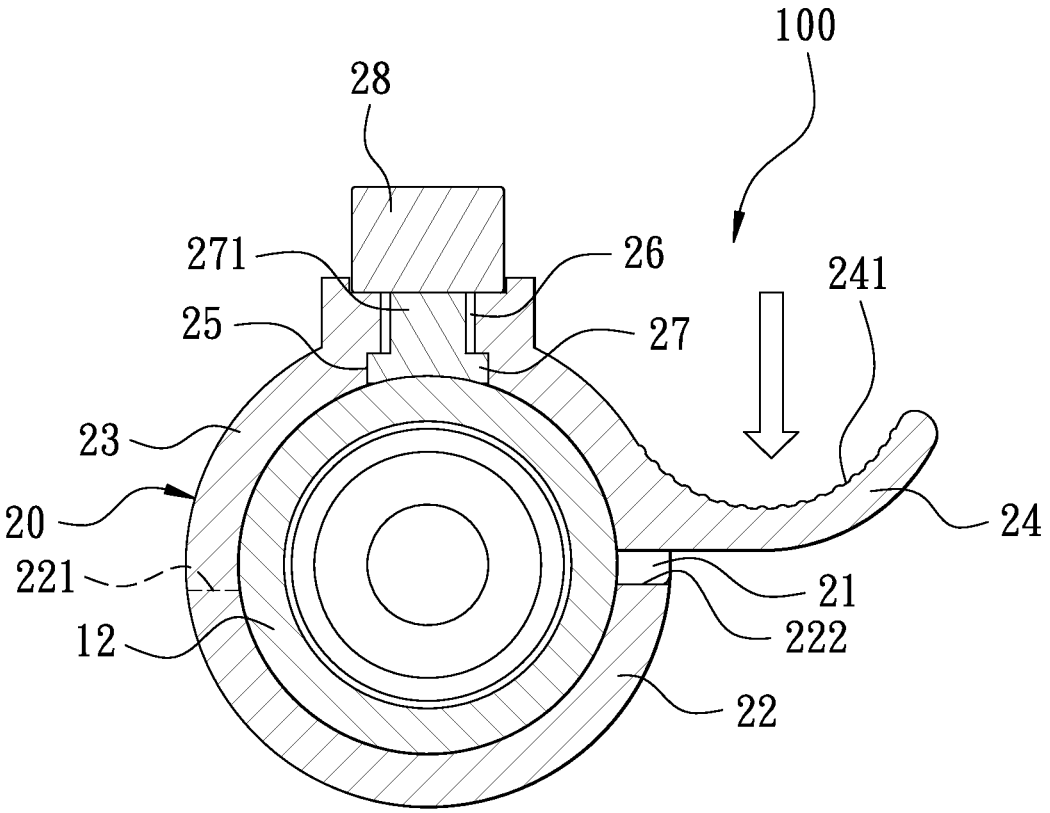
FIG. 7 is a cross-sectional view showing operation of the preferred embodiment of the present invention.
Figure 8:
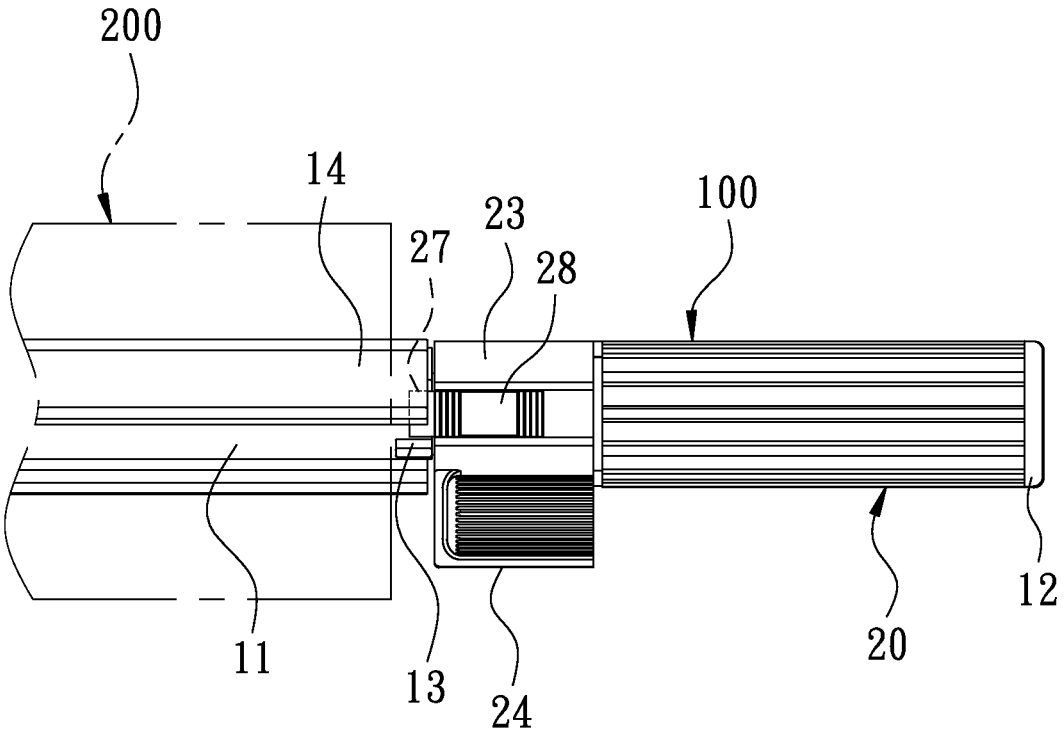
FIG. 8 is a top view showing operation of the preferred embodiment of the present invention.

Referring to FIG. 6 to FIG. 8, a roll of film 200 is installed on the axle rod 10 of the film packing device 100 with the fastening pieces 14 to prop up the roll of film 200. Because the grasp pipe 20 is fitted on the axle rod 10 and rotatable, the user can hold the grasp pipe 20 to pull the roll of film 200 toward the article (not shown in the drawings) to be packed. It is noted that when the user wants to stop pulling of the roll of the film 200 for a while, the user can press the press portion 24 to push the elastic brake member 23 downward, as shown in FIG. 7. The elastic brake member 23 cooperates with the brake block 22 to press the axle rod 10, such that the axle rod 10 stops rotating temporarily. When the user wants to stop using the roll of film 200 for a long time, the push block 28 is pushed to link the slide block 27, as shown in FIG. 8. The slide block 27 is pushed out of the slide channel 25, such that the slide block 27 engages with the engaging block 13 to stop rotation of the axle rod 10. Accordingly, the film packing device 100 of the present invention can assist the user in packing and the operation of packing can be stopped temporarily as desired. The present invention is user-friendly. When the user wants to adjust the position of the roll of film on the article, the user just presses the elastic brake member 23 which cooperates with the brake block 22 to stop rotation of the axle rod 10. When the user wants to pull the applied film, the slide block 27 is pushed to engage with the engaging block 13 to ensure that the axle rod 10 won't be rotated.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A film packing device, comprising:

an axle rod comprising at least one engaging block protruding from one side thereof;

a grasp pipe having a pipe body, the pipe body being fitted on the axle rod and rotatable, the pipe body comprising a semi-circle brake block at one end thereof close to the engaging block, the brake block having two opposing sides defined as a first side and a second side, the brake block being coupled with a semi-circle elastic brake member, one end of the elastic brake member being integrally formed with the first side of the brake block, another end of the elastic brake member being a free end and located corresponding to the second side of the brake block, the elastic brake member having an axial slide channel and a slide block provided in the slide channel, the slide block being able to be slid out of the slide channel to engage with the engaging block;

the axle rod comprises a connecting pipe and a fixing pipe which are connected to each other, and the axle rod comprises a plurality of engaging blocks; and the elastic brake member has a press portion extending outward from the free end of the elastic brake member, and the press portion has a concave thereon.

2. The film packing device as claimed in claim 1, wherein the connecting pipe has a positioning block at one end thereof, the positioning block has a plurality of engaging rings on an outer surface thereof, the fixing pipe has a positioning trough at one end thereof, and the positioning trough corresponds to the positioning block and has an inner wall which is formed with engaging grooves corresponding to the engaging rings.

3. The film packing device as claimed in claim 1, wherein the axle rod further comprises a plurality of spaced tightening pieces thereon.

4. The film packing device as claimed in claim 1, wherein the slide channel is disposed on an inner side of the elastic brake member facing the brake block, the elastic brake member has a through hole which communicates with the slide channel and is disposed opposite to the brake block, the slide block has a connection portion corresponding to the through hole, a push block is connected to the connection portion, the push block is located on an outer side of the elastic brake member opposite to the brake block.

* * * * *